United States Patent [19]

Linn

[11] Patent Number: 4,524,992

[45] Date of Patent: Jun. 25, 1985

[54] BINDING UNIT

[76] Inventor: Maynard W. Linn, 6336 N. Bergeron, Fresno, Calif. 93704

[21] Appl. No.: 454,320

[22] Filed: Dec. 29, 1982

Related U.S. Application Data

[63] Continuation-in-part of Ser. No. 362,021, Mar. 25, 1982.

[51] Int. Cl.[3] ..... B42D 17/00; B42D 5/00; B42F 9/00; A44B 21/00

[52] U.S. Cl. ..... 281/45; 281/35; 402/80 P; 24/255 R; 24/487

[58] Field of Search ..... 402/80 P, 60, 68; 281/34, 35, 45; 24/545, 548, 553, 556, 255 R, 67.5, 67.7; 238/378; D28/39, 40

[56] References Cited

U.S. PATENT DOCUMENTS

| | | | |
|---|---|---|---|
| 3,039,472 | 6/1962 | Duncan | 402/80 P |
| 3,542,321 | 11/1970 | Kahabka | 402/80 P |
| 3,733,656 | 5/1973 | Stalder | 24/255 R |

*Primary Examiner*—Paul A. Bell
*Assistant Examiner*—Paul M. Heyranasr
*Attorney, Agent, or Firm*—Don B. Finkelstein

[57] ABSTRACT

A device for binding the marginal edge of materials is provided which takes the form of a continuous section of resilient material. The section of the device includes a pair of legs on which the closing force can be released to allow the acceptance of the materials, a spline around which one of the legs pivots to close over the edge of the materials to hold them securely by the material engaging ends of the legs when the closing force is engaged and a latch to lock the legs closed.

19 Claims, 23 Drawing Figures

BINDING UNIT

This application is a continuation-in-part of previously filed U.S. patent application Ser. No. 362,021, filed Mar. 25, 1982, and the teaching and technology contained therein are incorporated herein.

BACKGROUND OF THE INVENTION

1. Field of the Invention

This invention relates generally to a binding and gripping unit for the edge of material, and, more particularly, to an improved binding unit which provides clamping pressure after a stack of material has been inserted into the binding unit, which clamping pressure can be released to allow the removal of the stack of material without damage.

2. Description of the Prior Art

Some prior proposed devices for binding sheet materials have required that each sheet be perforated adjacent one edge margin. If sheets are to be added, deleted or rearranged, the existing sheets must be removed from the device and then reinserted into the device. Often the perforations in the sheets become torn, with the result that a sheet may fall out of the assembled stack.

Other prior devices for binding sheet materials required that the stack of sheets be forced in between the clamping members to grip the inserted stack of papers and hold the sheets bound at the edge. Often this same resiliency causes the clamping members to damage the sheets as they are forced in between the clamping members. As the resiliency must be weak enough to allow the stack to be inserted, it is often weak enough to allow the stack to become dislodged during normal shuffling of the documents.

Certain prior art structures have attempted to alleviate this condition. One such device, as shown in U.S. Pat. No. 3,845,521, shows an adjustable binding unit which allows the gripping edges to be adjusted to accommodate a larger stack of materials. But the material must still be wedged between the gripping edges with the same magnitude of force that will hold the material, resulting in damage to the material if the force is great, or scattering of the material if the force is insufficient to hold the material during normal use.

U.S. Pat. Nos. 586,937; 2,282,565; and 2,869,210, show binding units which open to accept loose-leaf materials without perforations, but are designed for heavy duty applications to display materials, and none are proven to be completely satisfactory for the binding of small reports.

U.S. Pat. Nos. 3,665,563, and 3,698,043 show other binding units which are lightweight and open to accept loose-leaf materials, but are designed to be used in a plurality of units to prepare materials for display. Unless the units are tied together, they will cause portions of the materials to be folded under, with resulting damage to the loose-leaf materials.

SUMMARY OF THE INVENTION

Accordingly, it is the object of the present invention to provide a binding unit for loose-leaf sheets which opens to accept the stack of sheets and then closes around one edge of the stack.

It is another object of the present invention to provide the distinct advantage that the invention does not require perforations in the sheets to hold the sheets securely, nor does the invention require that the sheets be forced between the retaining means. Thus, the sheets can be inserted, taken out, rearranged, and inserted, without damage from the retaining means.

In my above identified, previously filed, U.S. patent application, Ser. No. 362,021, filed Mar. 25, 1982, the above and other objects of the present invention are achieved, according to a preferred embodiment thereof, by providing a binding unit which has two legs joined together near one end of the legs. The other end of the legs is free, and can be pivotally opened to accept the edge of the material. The free ends are then closed around an edge of a stack of material to clampingly secure the stacked material together. A latch is provided to hold the binding unit in the closed position. The binding unit can be unlatched and the free ends opened to allow the removal of the stack of material without damage.

As set forth herein, the invention achieves the above objects, according to a preferred embodiment thereof, by providing a binding unit which has two legs, joined together near one end of one leg and at the end of the other leg. The other end of the legs is free and one leg can be pivotally opened to accept the edge of the material. The free ends are then closed around an edge of a stack of material to clampingly receive the stacked material together. A latch is provided to hold the binding unit in the closed positions. The clamping pressure can be adjusted by closing the latch in several positions. The binding unit can be unlatched and the free ends opened to allow the removal of the stack of material without damage.

DESCRIPTION OF THE PREFERRED EMBODIMENTS

Figure 1:
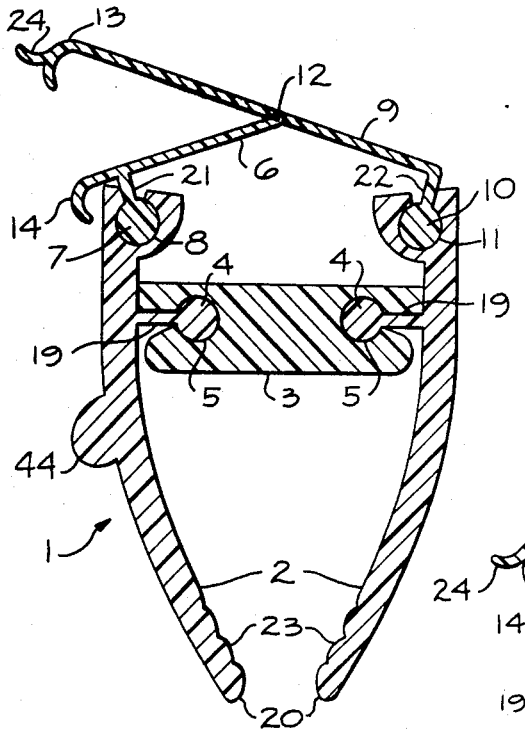
FIG. 1 is a sectional view, showing the cross section configuration of one embodiment of a binding unit according to this invention. The binding unit is shown in the open position.

As described in my above identified U.S. patent application Ser. No. 362,021, filed Mar. 25, 1982, referring now to FIG. 1, the binding unit 1 consists of two legs 2, each hinged to a spline 3 by a ball 4 and socket 5 joint. The ball 4 is made an integral part of the leg 2, being attached to the leg 2 by the stand off 19, and allows the leg 2 to pivot around the end of the spline 3. The spline 3 has a socket 5, formed to accept the ball 4 and allow movement of the ball 4 and stand off 19, such that each leg 2 will open and close to its operational limits without restriction from the spline 3. The free edges 20 of the legs 2 are formed with material engaging end portions 23.

The material engaging end portions 23 are shown as a series of ridges. The ridges should have a smooth surface so as not to damage the loose-leaf material, and the size of the ridges should be selected so as not to impress a pattern into the loose-leaf material. The ridges can be designed so that the top of opposing ridges engage each other, or so that the tops of one set of ridges engages the valleys of the other set of ridges.

Figure 2:
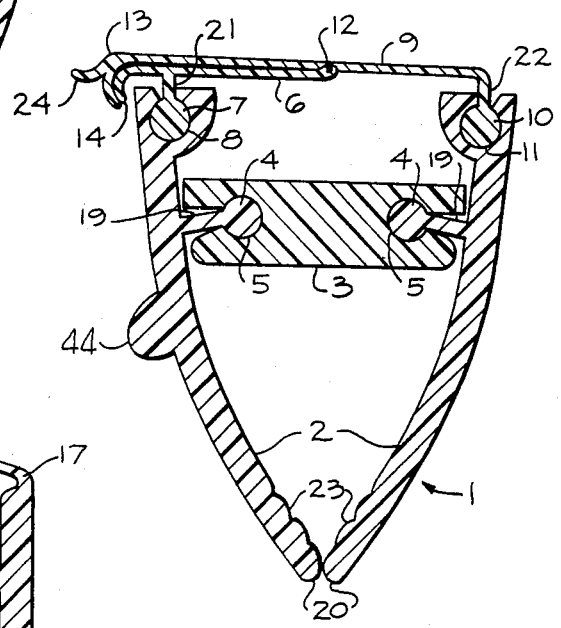
FIG. 2 is a sectional view, showing the cross section of the same embodiment of a binding unit in a closed position.

As can be seen from FIGS. 1 and 2, the members 6 and 9, which open and close the legs 2, are attached at the ends of the legs 2. The shorter member 6 is hinged to the end of one leg 2 by a ball 7 and socket 8 joint. The ball 7 is made an integral part of the shorter member 6, being attached by the stand off 21 to allow the shorter member 6 to pivot around the end of the leg 2. A socket 8 is formed in the end of the leg 2, such that the shorter member 6 can be opened and closed. The longer member 9 is hinged to the end of the other leg 2 by means of a ball 10 and socket 11 joint, with the ball 10 made an integral part of the longer member 9, being attached by the stand off 22. The socket 11 is formed in the end of the leg 2, such that the longer member 9 can be opened and closed. The shorter member 6 is attached to the longer member 9 by a hinge 12, which is shaped to allow the longer member 9 to close over the shorter member 6. The hinge 12 is placed along the longer member 9, such that when the longer member 9 is closed over the shorter member 6, the legs 2 are pivoted around the spline 3 to the closed position shown in FIG. 2, with the material engaging end portions 23 forced together to hold loose-leaf sheet materials.

The end of the shorter member 6 is terminated in a catch 14. The end of the longer member 9 is terminated in a latch 13, which is placed so that when the longer member 9 is closed over the shorter member 6, the latch 13 engages the catch 14 to hold the members 6 and 9 closed.

The latch 13 is formed with a manipulation pad 24 to facilitate the opening and closing of the latch 13. A second manipulation pad 44, as shown in FIG. 1, may be formed as part of a leg 2 to provide a fingerhold to steady the binding unit 1, while closing or opening the latch 13. The second manipulation pad 44 may be placed on the leg 2, and constructed to be of a height such that, when the binding unit 1 holding a stack of material is set flat, the edges of the manipulation pad 24 and second manipulation pad 44 allow the binding unit 1 to lie in the same plane as the stack of material.

As the longer member 9 is opened, the ends of the legs 2, attached to members 6 and 9, are drawn closer together. This movement forces the legs 2 to pivot around the spline 3, so that the free edges 20 are opened to release any retained materials, and allow another stack of material to be placed between the legs 2, to be clampingly retained when the members 6 and 9 are closed.

Figure 3:
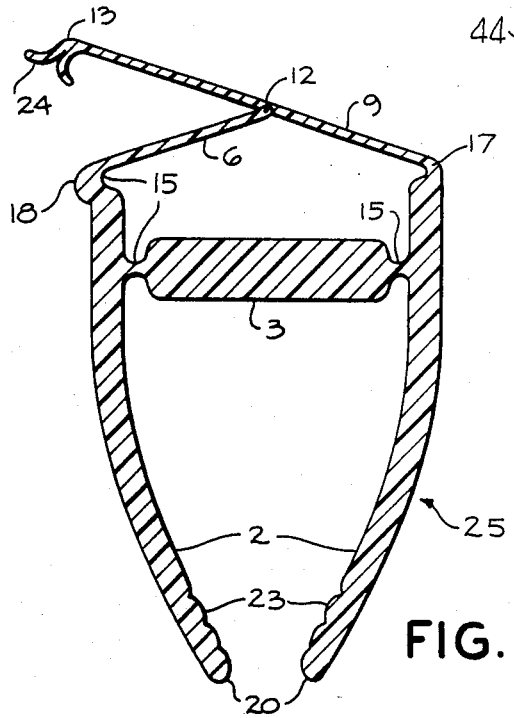
FIG. 3 is a sectional view, showing a modified form of the invention in an open position.

FIG. 3 illustrates an embodiment, generally designated 25, which is generally similar to the binding unit 1. Each leg 2 is joined to one end of the spline 3 by a flexible web 15, serving as a hinge. The shorter member 6 is joined to one leg 2 by a flexible web 16. The longer member 9 is joined to the other leg 2 by a flexible web 17. A catch 18 is formed as an integral part of the leg 2 which is attached to the shorter member 6. The latch 13 engages the catch 18 when the longer member 9 is closed over the shorter member 6.

Figure 4:
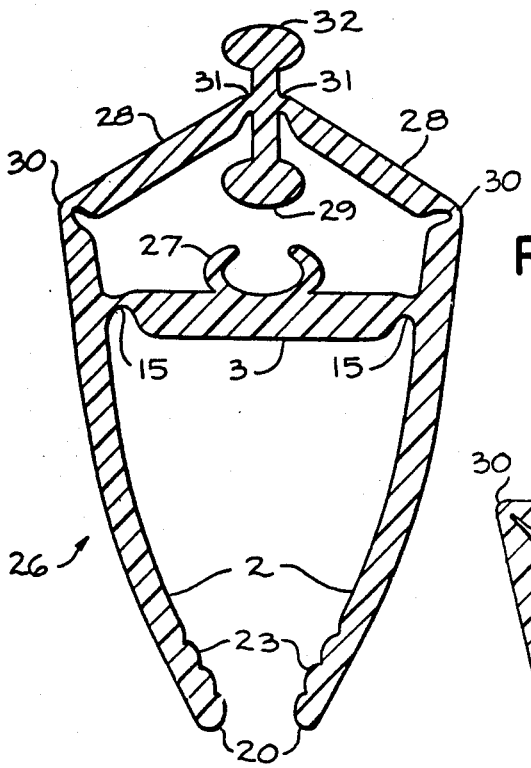
FIG. 4 is a sectional view of a further modification of the invention with the clamping members attached to a wedge in the open position.
Figure 5:
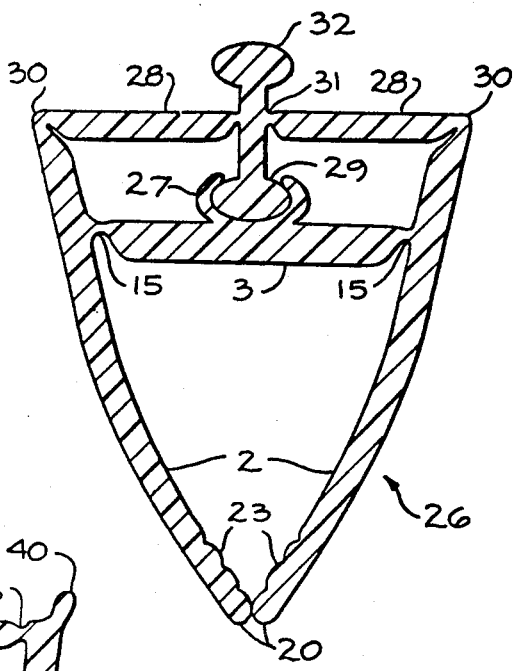
FIG. 5 is a view similar to FIG. 4, but showing the binding unit in the closed position.

FIGS. 4 and 5 illustrate another embodiment, generally designated 26, which is generally similar to the binding unit 1. The legs pivot around the spline 3. Each leg 2 is attached to a forcing member 28 by a flexible web 30. The other end of each forcing member 28 is attached to a wedge 29 by a flexible web 31. A keeper 27 is formed as an integral part of the spline 3, and positioned to receive the wedge 29. When the wedge 29 is inserted into the keeper 27, the forcing members 28 spread the remote ends of the legs 2, causing the legs 2 to pivot around the spline 3 so that the free edges 20 close and the material engaging end portions 23 can clampingly engage a stack of loose-leaf materials. The top of the wedge 29 extends to form a fourth manipulation pad 32 so that the wedge 29 can be easily removed from the keeper 27 to open the free edges 20 of the legs 2.

Figure 6:
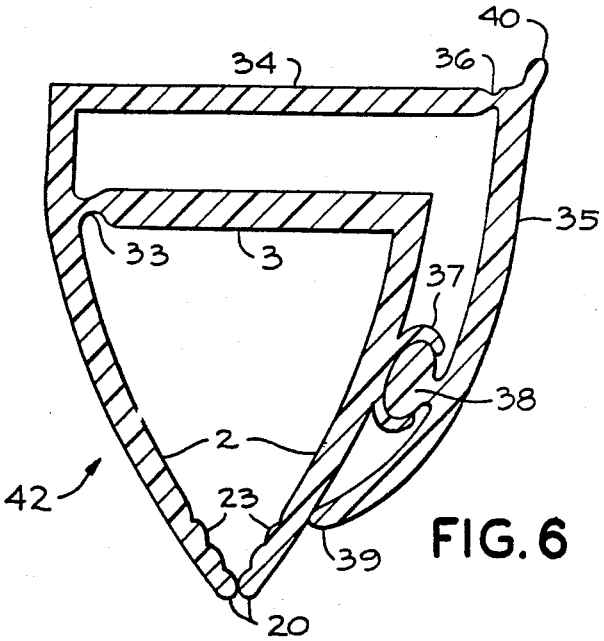
FIG. 6 is a sectional view of another embodiment of the invention, showing clamping members retained by one of the legs.
Figure 7:
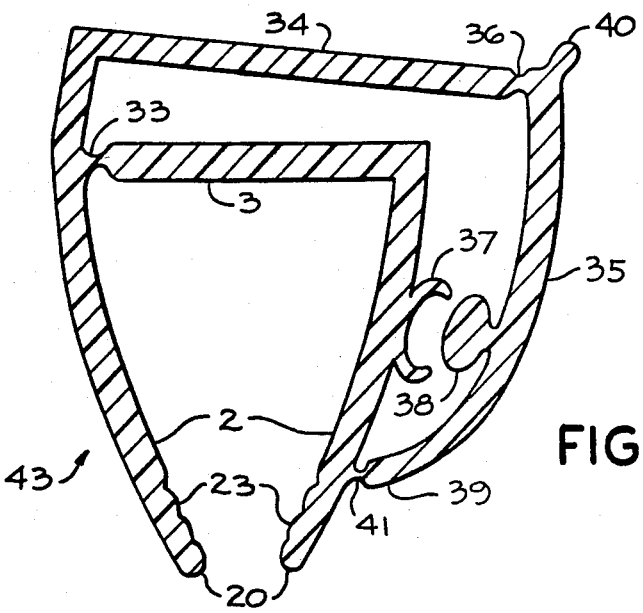
FIG. 7 is similar to FIG. 6, but with the binding unit in the open position.

FIGS. 6 and 7 show still other embodiments, generally designated 42 and 43, of the binding unit 1.

FIG. 6 shows one leg 2 joined to the spline 3 by a flexible web 33, so that the leg 2 can pivot around the spline 3. The other leg 2 is non-pivotally attached to the spline 3. A keeper 37 is made an integral part of the non-pivotal leg 2.

A first clamping member 34 is rigidly attached to the remote end of the pivotal leg 2. The first clamping member 34 is attached to a second clamping member 35 by a flexible web 36. A wedge 38 is formed as an integral part of the second clamping member 35, and positioned so that, as the wedge 38 is inserted into the keeper 37, one end 39 of the second clamping member 35 will act as a fulcrum. The second clamping member 35 will then pivot around the fulcrum and apply a force through the first clamping member 34 to the pivotal leg 2. The shape of the second clamping member 35 is selected so that when the wedge 38 is inserted into the keeper 37, the material engaging end portions 23 can be clampingly secured on the edge of a stack of loose-leaf materials.

A third manipulation pad 40 is formed as an integral part of the second clamping member 35 to facilitate the removal of the wedge 38 from the keeper 37. This removal opens the free edges 20 of the embodiment 42 to release any secured material and allow another stack of material to be placed between the legs 2 to be held by the embodiment 42, after the wedge 38 is engaged in the keeper 37.

FIG. 7 illustrates a modification of the embodiment 42 shown in FIG. 6. The operation of the modified embodiment 43 is similar to that of the embodiment 42, except that the second clamping member 35 is joined to the non-pivotal leg 2 by a flexible web 41 to facilitate the alignment of the wedge 38 with the keeper 37, while closing the modified embodiment 43.

Certain of the embodiments are shown to have the free edges 20 apart when the opening and closing means is open. This state is not necessary, and for certain uses, such as binding a small number of loose-leaf sheets, it may be preferred to have the free edges touching when the opening and closing means is open, so that additional clamping force can be generated by the closing of the opening and closing means to more securely hold a thin stack of material.

Figure 8:
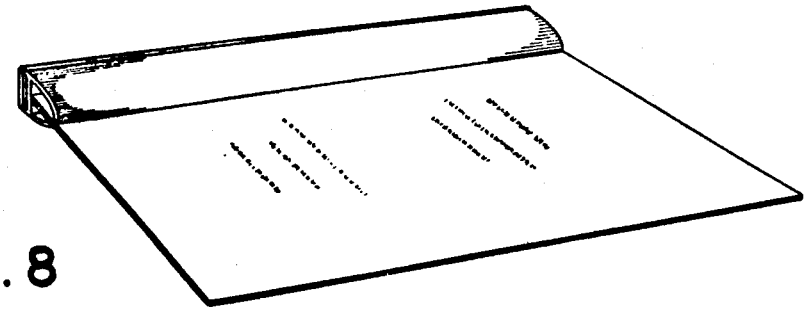
FIG. 8 is a perspective view, showing the binding unit utilized to bind one edge of a stack of loose-leaf sheets.

Referring now to FIG. 8, there is shown in perspective a stack of loose-leaf sheets temporarily bound together at one edge by means of the binding unit. The strip depicted is not intended to represent any specific embodiment, but rather depicts a manner in which strips of the binding unit are utilized.

Figure 9:
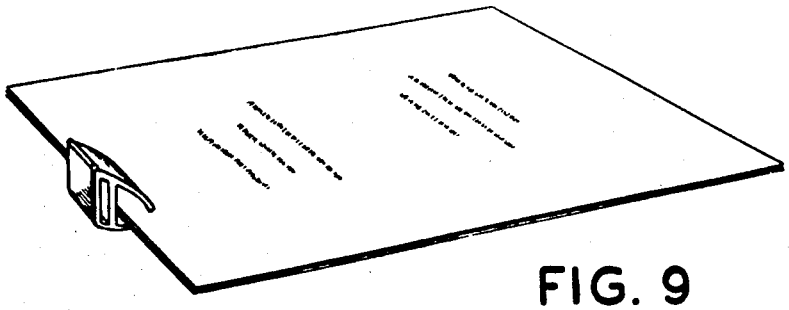
FIG. 9 is a perspective view, showing a length of the binding unit utilized to temporarily hold a stack of loose-leaf sheets together at one portion of an edge.

Referring now to FIG. 9, there is shown, in perspective, a stack of loose-leaf sheets temporarily held together along a portion of an edge by means of a length of the binding unit. The length depicted is not intended to represent any specific embodiment or size, but rather depicts a manner in which less than full edge lengths of the binding unit are utilized to temporarily bind loose-leaf materials.

FIGS. 10*a*, 10*b*, 10*c*, and 10*d*, show still another embodiment, generally designated 70, of the binding unit 1. This embodiment is similar to that shown in FIGS. 6 and 7, except that it can be shifted to have different clamping positions and thus different clamping forces.

Figure 10A:
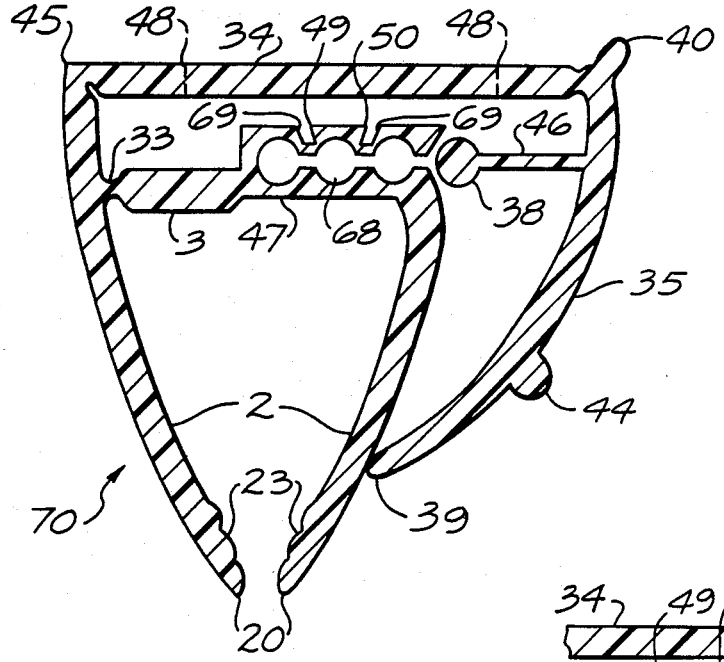
FIG. 10*a* is a sectional view of another embodiment of the invention, showing a latch for the clamping members in the open position.

FIG. 10*a* shows one leg 2 joined to the spline 3 by a flexible web 33, so that the leg 2 can pivot around the spline 3. The other leg 2 is non-pivotally attached to the spline 3. It will be appreciated that certain modifications to the structure illustrated in FIG. 10*a* may be made. For example, the function of the flexible web 33 may also be accomplished by a ball and socket joint, pin hinge, or the like.

The first walls 68, inside the keeper 47 provide a plurality of holes to hold a wedge 38 in three positions. Keeper 47 is made an integral part of the spline 3. The thickness of the material which is used to form the keeper 47 is selected to provide a rigid support between the legs 2, and yet allow the insertion of the wedge 38. The removal of material to form the third or groove walls 69 which partially define grooves in the top of the keeper 47 adds even more flexibility to the keeper 47 to ease the insertion and removal of the wedge 38. The edges at the opening to first walls 68 of the keeper can be shaped to facilitate the movement of the wedge 38 into and out of any one of the three positions in the keeper 47.

A first clamping member 34, having second or access walls 48 defining a plurality of holes, is rigidly attached to a second clamping member 35 at a preselected angle so that the position of the second clamping member 35 will not restrict the removable insertion of the wedge 38 into the keeper 47. The other end of the first clamping member 34 is coupled to the pivotal leg by being attached to the remote end of the pivotal leg 2 by a flexible web 45. A wedge 38 is formed as an integral part of the second clamping member 35, being attached by the stand off 46 and positioned so that as the wedge 38 is inserted into the keeper 47, an end 39 of the second clamping member 35 will act as a fulcrum. The second clamping member 35 will then pivot around the fulcrum and apply a force through the first clamping member 34 to the pivotal leg 2. The end 39 of the second clamping member 35 could be attached to the non-pivotal leg 2 by means such as a flexible web 41 shown in FIG. 7.

The closing edge 49, formed by third walls 69 in the keeper 47, accessible through the holes in the first clamping member 34, provides a place to grip the binding unit 70 as the wedge 38 is inserted into the keeper 47. The holes formed by second walls 48 in the first clamping member 34 which provide access to the closing edge 49 are positioned so as not to interfere with the movement of the first clamping member 34 as the wedge 38 is inserted into, or removed from, keeper 47.

Figure 10B:
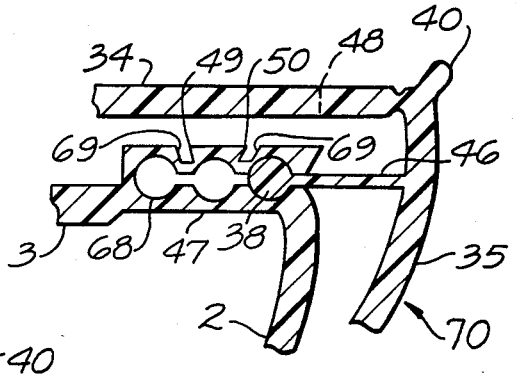
FIG. 10*b* is similar to FIG. 10*a*, but showing the latch in the first closed position.
Figure 10C:
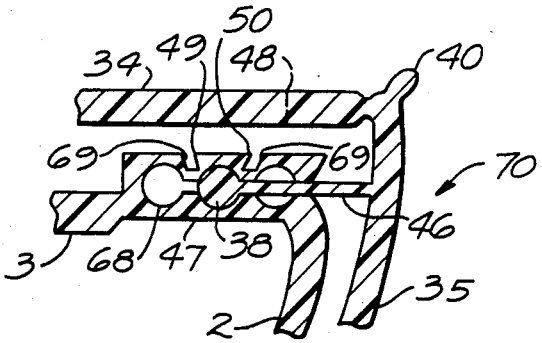
FIG. 10*c* is similar to FIG. 10*a*, but showing the latch in the second closed position.
Figure 10D:
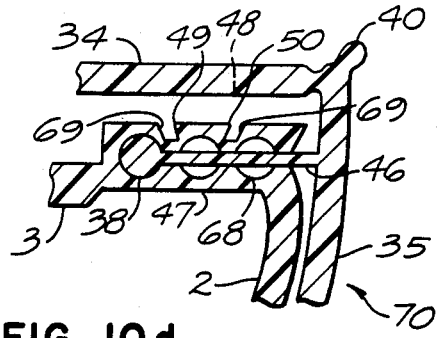
FIG. 10*d* is similar to FIG. 10*a*, but showing the latch in the third closed position.

The shape of the second clamping member 35 is selected so that when the wedge 38 is inserted into the first position of keeper 47, as shown in FIG. 10*b*, the material engaging end portions 23 can be clampingly secured on the edge of a stack of loose-leaf material. By moving the wedge 38 into the second position of the keeper 47, as shown in FIG. 10*c*, the binding unit applies increased force to clampingly secure the edge of a stack of loose-leaf material. By again moving the wedge 38 into the third position of the keeper 47, as shown in FIG. 10*d*, the force that clampingly secures the edge of a stack of loose-leaf material is further increased.

A third or end manipulation pad 40, formed as an integral part of the second clamping member 35, and the opening edge 50, formed by the third walls 69 in the keeper 47, are provided to facilitate the removal of the wedge 38 from the keeper 47. This removal opens the free edges 20 of the embodiment 70 to release any secured material and allow another stack of material to be place between the legs 2, to be held upon the subsequent engagement of wedge 38 into keeper 47.

A second or second clamping member manipulation pad 44, as shown in FIG. 10*a*, may be formed as part of the second clamping member 35, to provide a finger-hold while inserting the wedge 38 into the keeper 47. The second manipulation pad 44 may be placed on the second clamping member 35 and constructed to be of a height such that when the binding unit 70 holding a stack of material is set flat, the edges of the manipulation pad 40 and second manipulation pad 44 allow the binding unit 70 to lie in the same plane as the stack of material.

Figure 11:
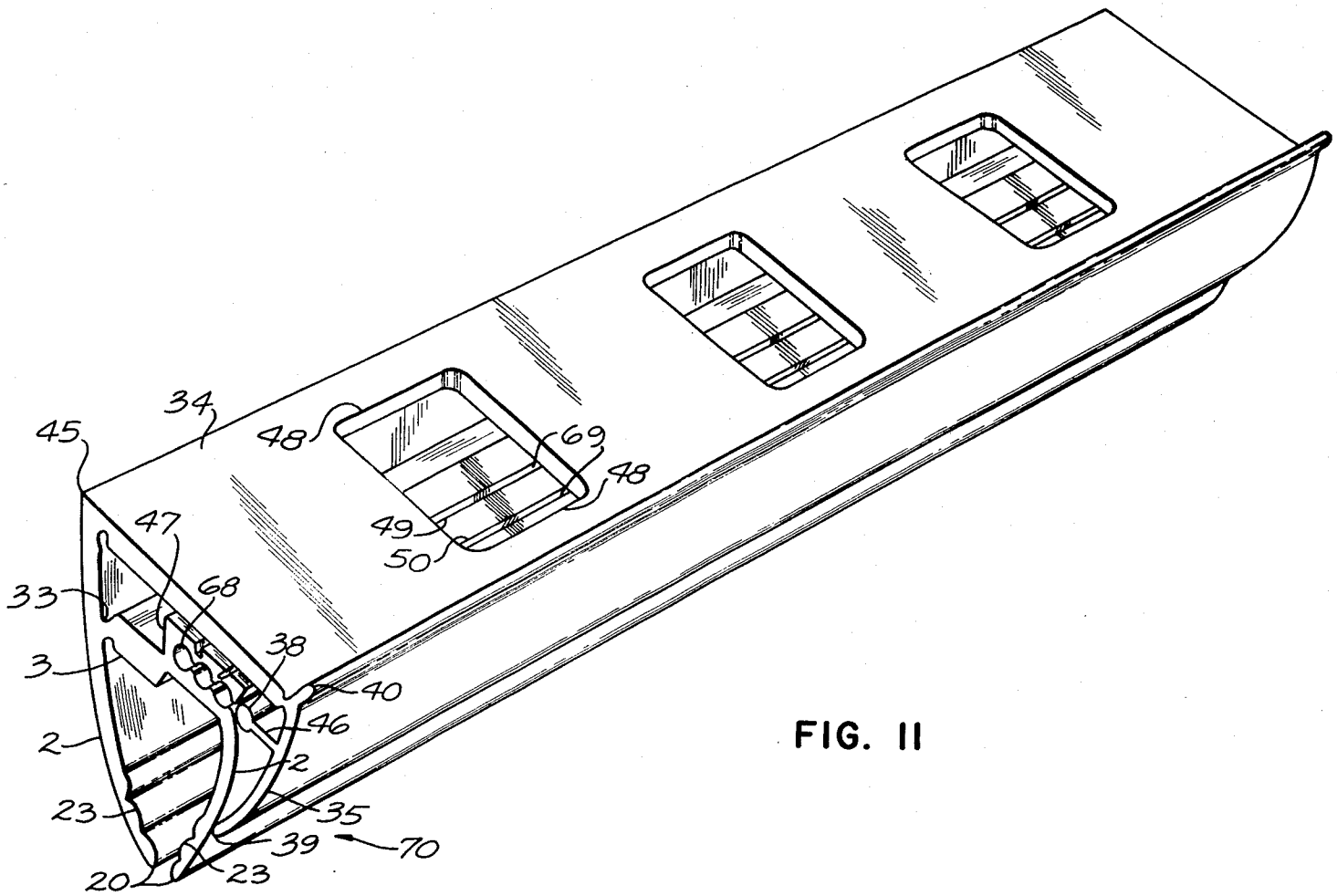
FIG. 11 is a perspective view of a strip of the binding unit sectional shown in FIG. 10*a*.

FIG. 11 shows third walls 69 forming grooves with edges 49 and 50 along the keeper 47.

FIG. 11 shows that the second walls 48 form holes placed periodically along a length of binding unit 70 to allow access to closing edge 49 and opening edge 50.

The user can engage closing edge 49 through the holes to provide a handle on the binding unit 70 while applying pressure to the second clamping member 35 to force the wedge 38 into the keeper 47. In a similar manner, the user can engage opening edge 50 to provide a handle on the binding unit 70 while applying pressure to the third manipulation pad 40 to force the wedge 38 out of the keeper 47.

Figure 12:
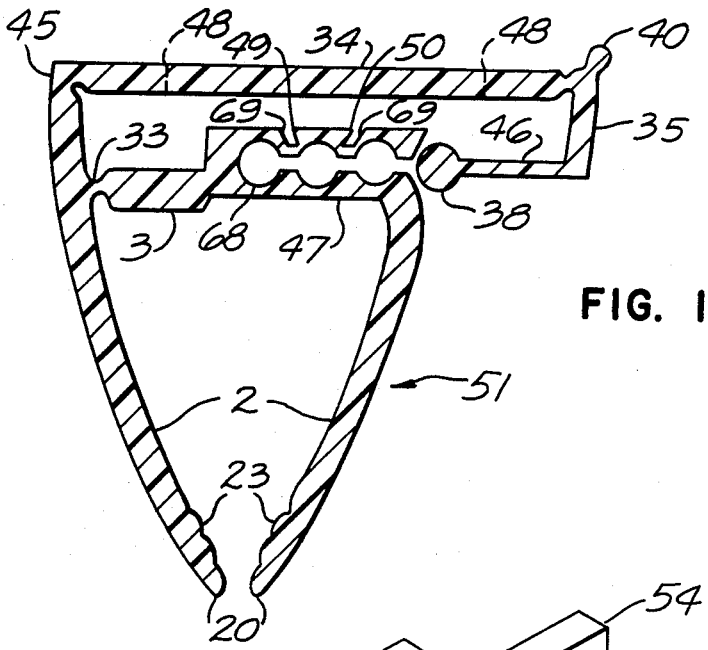
FIG. 12 is a sectional view of another embodiment of the invention, showing a latch on a spline connecting the legs.

FIG. 12 illustrates a modification of the embodiment 70 shown in FIG. 10*a*. The operation of the modified embodiment 51 is similar to that of the embodiment 70, except that the second clamping member 35 is used only to join the first clamping member 34 to the stand off 46, and does not extend beyond the stand off 46. When the wedge 38 is inserted into the keeper 47, a force is applied through the first clamping member 34 to the pivotal leg 2, closing the material engaging end portions 23 on the edge of a stack of loose-leaf material.

Figure 13:
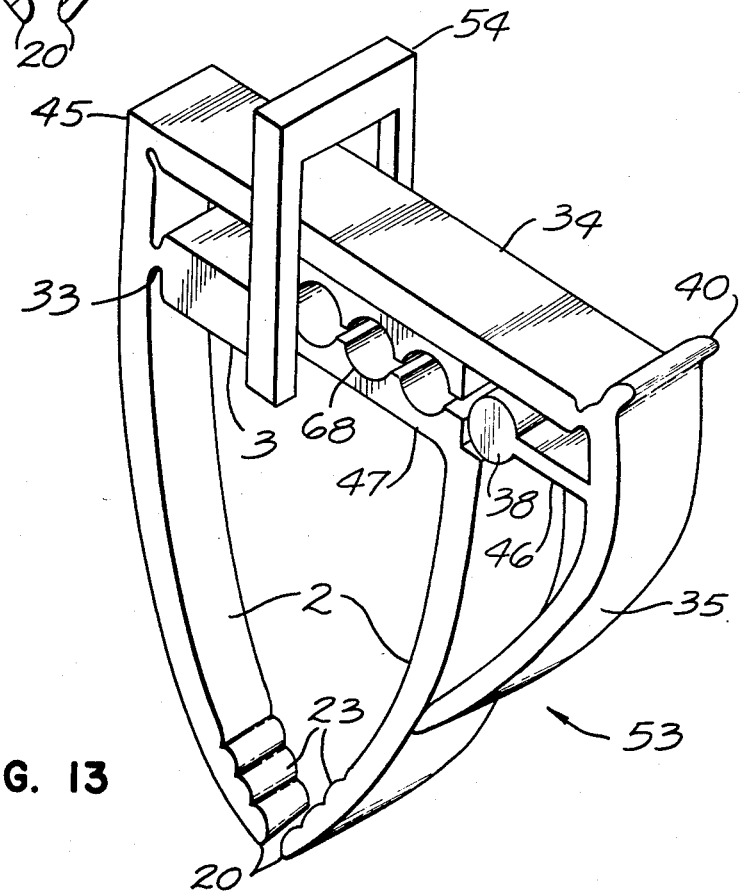
FIG. 13 is a perspective view of another embodiment of the invention, showing a handle on the spline.

FIG. 13 shows still another embodiment, generally designated 53, of the binding unit 1. The operation of this embodiment is similar to that of the embodiment 70, except that the first clamping member 34 does not allow access to the keeper 47. A handle 54 is made an integral part of the spline 3 and keeper 47, and is positioned to allow the first clamping member 34 to move freely between the sides of the handle 54. The handle 54 provides a place to hold onto the binding unit 53 as the wedge 38 is inserted into, or removed from, the keeper 47.

Figure 14:
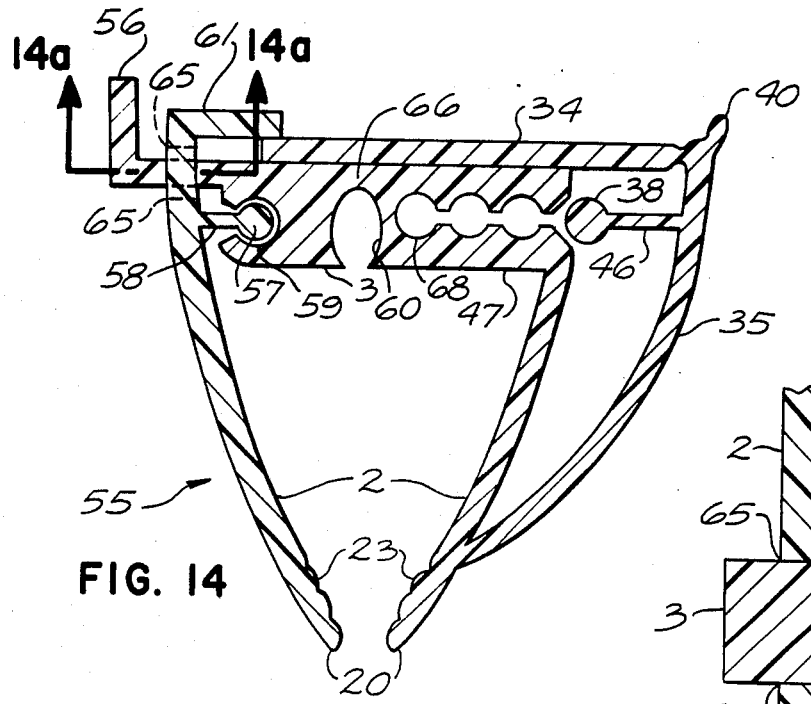
FIG. 14 is a sectional view of another embodiment of the invention, showing a handle formed by an extension of the spline.

FIG. 14 shows still another embodiment, generally designated 55, of the binding unit 1. The operation of this embodiment is similar to that of embodiment 53. The second or end spline handle 56 of this embodiment is rigidly attached to the end of an extension of the spline 3 at a point outside of the pivotal leg 2.

Figure 14A:
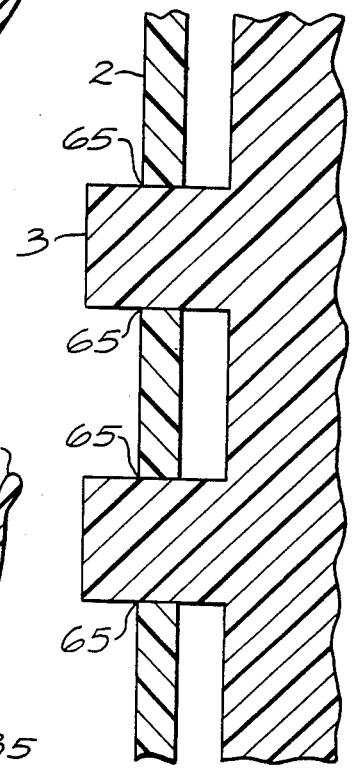
FIG. 14*a* is a sectional view of FIG. 14, showing how the handle extends through the leg.

FIG. 14*a* shows how fourth or pivotal leg walls 65 define openings in the leg 2, through which the extensions of the spline 3 pass. The fourth walls 65 are placed so as not to limit the freedom of movement of either the spline 3 or the pivotal leg 2.

FIG. 14 shows the pivotal leg 2 attached to the spline 3 by means of a ball 57 and socket 59 joint. The ball 57 is made an integral part of the leg 2, being attached to the leg 2 by the stand off 58. The spline 3 has a socket 59 formed to accept the ball 57 and allow movement of the ball 57 and stand off 58 such that the pivotal leg 2 will open and close to its operational limits without restriction from the spline 3. A lip 61 is rigidly attached to the remote end of the pivotal leg 2. The first clamping member 34 is rigidly attached to the second clamping member 35, but is not coupled to the pivotal leg 2 by being attached to the pivotal leg 2. Instead, the lip 61 is located so as to hold the first clamping member 34 above the keeper 47 and spline 3.

The second clamping member 35 is rigidly attached to the non-pivotal leg 2 at a point such that the wedge 38 is aligned with the keeper 47.

A fifth or spline wall 60 defines a rounded groove in the spline 3 to form a flexible web 66 in the spline 3, such that the free ends 20 of the legs 2 can be opened wider than allowed by just the pivotal movement of leg 2. After the pivotal leg 2 has reached its normal open operational limit, the spline 3 will bend at the flexible web 66 to allow the legs 2 to be further opened to accept a stack of loose-leaf material. The spline can then return to a non-flexed configuration as the legs 2 close around the stack of loose-leaf material. Thus, this embodiment can accept a wide range of thicknesses of stacked sheets without damaging the sheets as they are inserted or removed. The second handle 56 will allow the user to hold the binding unit 55 while force is applied to the outside of the second clamping member 35 to insert the wedge 38 into the desired position of the keeper 47 to clampingly retain the loose-leaf material with the selected force in a latched state.

The second handle 56 can also be used to hold the binding unit 55 while force is applied to the third manipulation pad 40 to remove the wedge 38 from the keeper 47 to release the loose-leaf material or lessen the force which clampingly retains the stack of loose-leaf material.

As the wedge 38 is inserted into the keeper 47, the first clamping member 34 slides under the lip 61 to apply a force on the remote end of the pivotal leg 2, causing the pivotal leg 2 to pivot around the spline 3 to close the material engaging end portions 23 to clampingly hold loose-leaf sheet materials.

Figure 15:
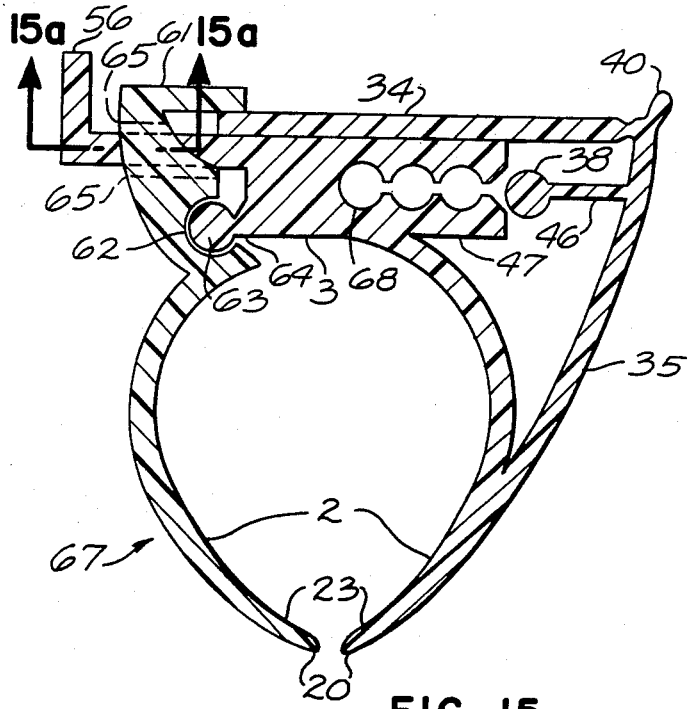
FIG. 15 is a sectional view of another embodiment of the invention, showing a handle on an extension of the spline and shaped legs.

FIG. 15 shows yet another embodiment, generally designated 67, of the binding unit 1. The operation of this embodiment is similar to that of embodiment 55.

Figure 15A:
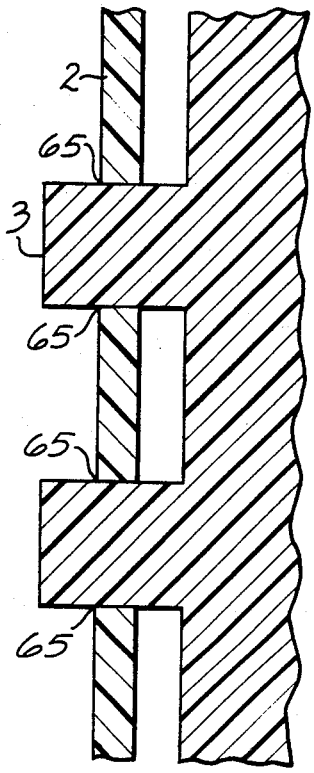
FIG. 15*a* is a sectional view of FIG. 15, showing how the handle extends through the shaped leg.

FIG. 15*a* shows how the fourth walls 65 define holes in the remote end of the pivotal leg 2 through which pass the extensions of the spline 3 which are rigidly attached to the second handle 56.

FIG. 15 shows that the pivotal leg 2 is attached to the spline 3 by means of a ball 63 and socket 62 joint. The ball 63 is made an integral part of the spline 3, being attached to the spline 3 by the stand off 64. The pivotal leg 2 has a socket 62 formed to accept the ball 63 and allow movement of the pivotal leg 2 to its operational limits without restriction from the spline 3.

A lip 61 to hold the first clamping member 34 on top of the keeper 47 and spline 3 is also provided.

The legs 2 of binding unit 67 are depicted in one of several possible configurations for a binding unit. This configuration has each leg formed to curve outwardly from the point where they are attached to the spline to a point where the legs become parallel, and then curve inwardly as the legs terminate with the material engaging end portions 23. The legs could be formed to be straight from the remote end to the free end 20, so that the outer surface of the legs 2 become closer together when the binding unit is in the closed position. The legs could also be formed to converge inwardly from the spline 3 to the free end 20 while that portion of the pivotal leg 2 from the spline 3 to the remote end is generally perpendicular to the spline 3. The legs could likewise be formed to taper inwardly from the spline 3 to the remote end and inwardly from the spline 3 to the free end 20.

Figure 16:
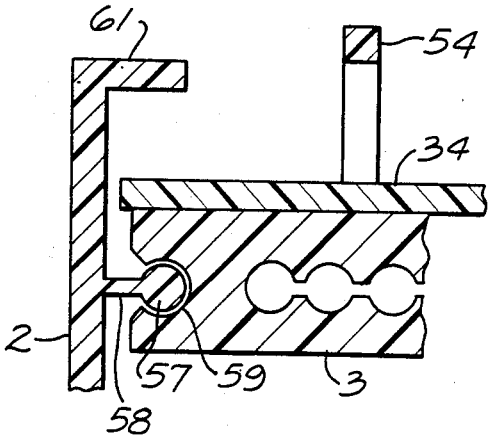
FIG. 16 is a sectional view of a modification to an embodiment of the invention, showing a handle on the spline and an extended leg.

FIG. 16 shows a modification of embodiments 55 and 67 shown in FIGS. 14 and 15, respectively. This modification substitutes the handle 54 used in embodiment 53, depicted in FIG. 13 for the second handle 56. This modification also shows an elongation of the remote end of the pivotal leg 2 between the lip 61 and the point where the pivotal leg 2 is attached to the spline. This elongation will allow the first clamping member 34 to engage the pivotal leg 2 at any point between the spline 3 and the lip 61, depending upon the thickness of the stack of loose-leaf material and the selected position of the wedge 38 in the keeper 47.

The flexible webs which function as a hinge in FIGS. 3, 4, 5, 6, 7, 10*a*, 11, 12, and 13, can be formed of the same material as the binding unit, but of a reduced thickness, to allow the material to bend easily at that point. The edges adjacent the flexible webs must be formed in a manner which does not restrict the freedom of movement of the members attached to the flexible webs.

The above flexible webs could be constructed of fabric, the ends of which are embedded in the members to be joined by the flexible webs.

Figure 17:
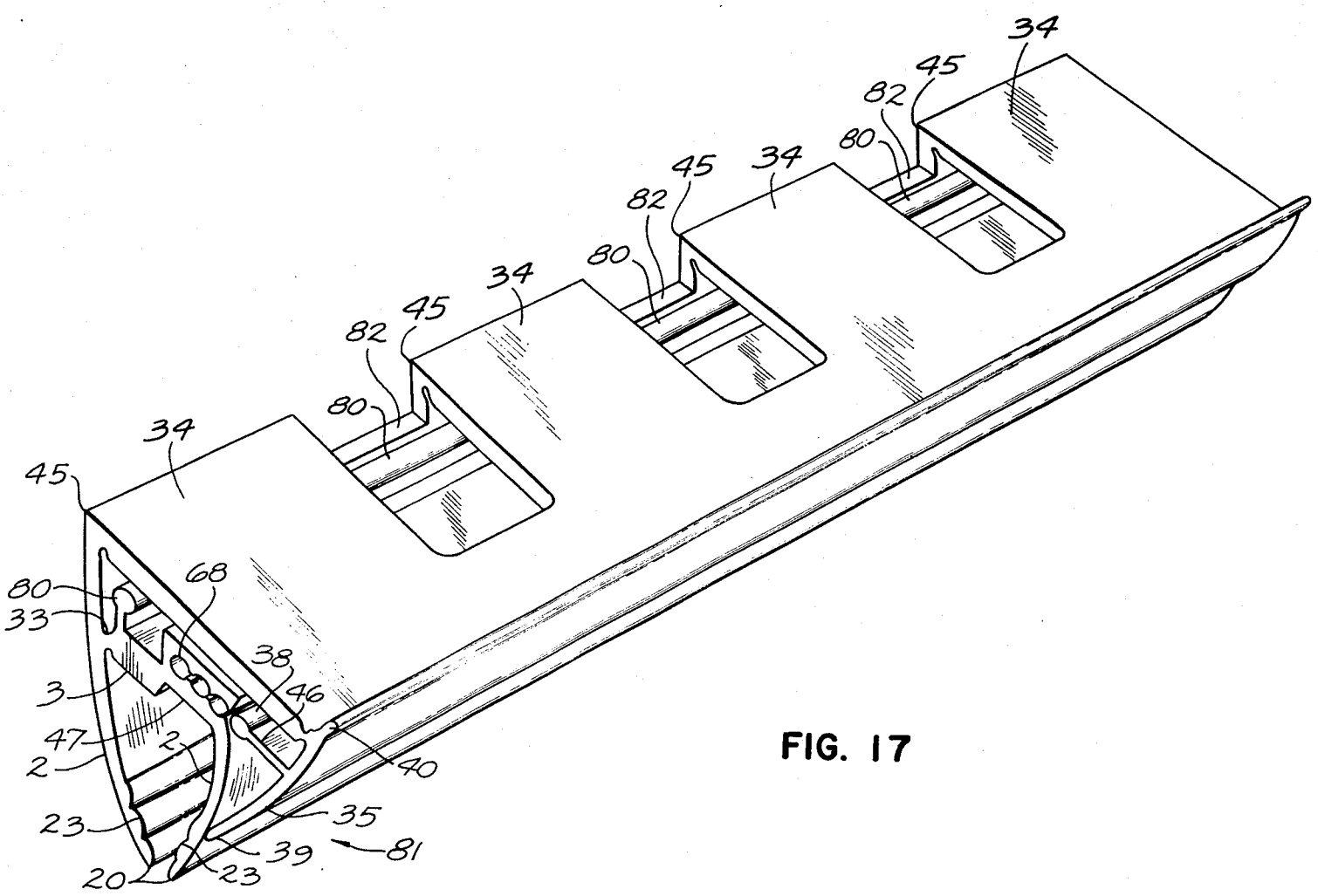
FIG. 17 is a perspective view of a modification to the embodiments of the invention, showing a third manipulation pad mounted on the spline.

FIG. 17 depicts yet another embodiment, generally designated 81, of the binding unit 1. The operation of this embodiment is similar to that of embodiment 70.

FIG. 17 shows how the sixth or remote end walls 82 define a plurality of holes placed periodically in the remote end of the pivotal leg 2 and continuing in the first clamping member 34. These holes allow access to the fifth or spline manipulation pad 80 located at the edge of the spline 3 nearest the remote end of the pivotal leg 2. The size and position of the holse are selected so as not to interfere with the movement of the first clamping member 34 and such that the user can then engage the fifth manipulation pad 80 while forcing the wedge 38 into or out of the keeper 47.

The fifth manipulation pad 80 can be placed along the entire length of the spline 3 as shown in FIG. 17 or only placed at the holes created by the sixth walls 82. As the fifth manipulation pad 80 provides a handle, the closing edge 49 and opening edge 50 formed by third walls 69 in binding unit 70 are not necessary for handle purposes in binding unit 81. Otherwise the operation of binding unit 81 is similar to binding unit 70.

Figure 18:
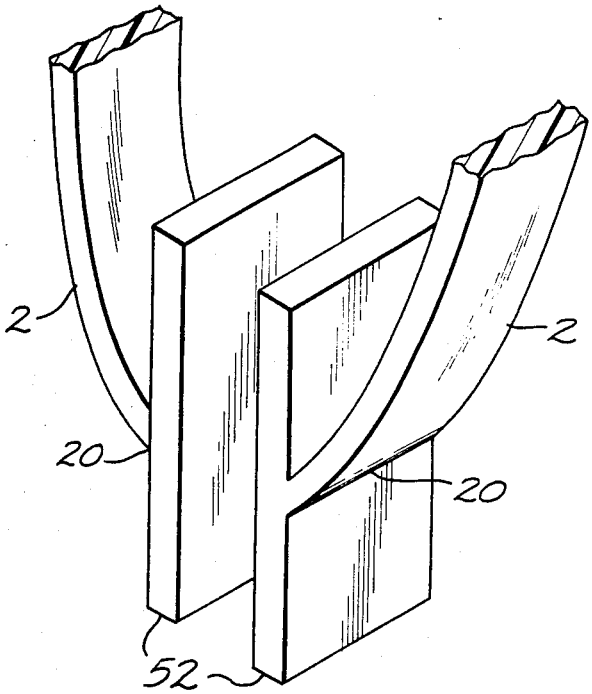
FIG. 18 is a perspective view of a modification to the embodiments of the invention, showing material engaging plates.

FIG. 18 depicts a modification of the embodiments shown in FIGS. 1 through 7 and FIGS. 10*a* through 17. This modification incorporates enlarged material engaging plates 52 at the free edges 20 of the legs 2 to clampingly secure the stack of loose-leaf material after it has been inserted between the legs 2. The opposing planar surfaces of the plates 52 provide a larger area to clampingly receive the stack than the area supplied by the opposing ridge configuration. The planar surface of the plates 52 promotes the object of this invention to provide a binding unit which does not damage the stack, particularly with the increased clamping force provided by embodiments 51, 53, 55, 67, or 70.

Since certain changes may be made in the above apparatus without departing from the scope of the invention herein involved, it is intended that all matter contained in the above description, as shown in the accompanying drawing, shall be interpreted in an illustrative, and not in a limiting, sense.

What is claimed is:

1. A binding unit for loose-leaf sheet materials or the like comprising a continuous section of resilient material having two legs, connecting means joining the legs near one end portion of one of the legs and at the end portion of the other leg, the legs extending from the connecting means and each leg terminating in a free edge, the free edges having cooperating material engaging end portions, the connecting means including a spline disposed to provide pivotal movement to the one leg attached to the spline by hinge means at a point on the leg between the free edge of the leg and the end remote from the free edge, the spline being non-pivotally fixed to the end of the other leg, a keeper means mounted on the spline, a wedge that can be retained by the keeper, and means for closing the unit, the closing means including two clamping members being non-pivotally joined together, the end of the first clamping member being pivotally attached by hinge means to the end of the pivotal leg remote from the free edge and generally aligned in a plane parallel to the spline, the second clamping member having the wedge mounted on it disposed to be retained in the keeper said closing means providing means to pivot said pivotal leg when said wedge is retained by said keeper.

2. A binding unit for loose-leaf sheet materials or the like, comprising a continuous section of resilient material having two legs, connecting means joining the legs near one end portion of one of the legs, and at the end portion of the other leg, the legs extending from the connecting means and each leg terminating in a free edge, the free edges having cooperating material engaging end portions, the connecting means including a spline disposed to provide pivotal movement to the one leg attached to the spline by hinge means at a point on the leg between the free edge of the leg and the end remote from the free edge, the spline being non-pivotally fixed to the end of the other leg, a keeper means mounted on the spline, a wedge that can be retained by the keeper, and means for closing the unit, the closing means including two clamping members being non-pivotally joined together, the end of the first clamping member being pivotally attached by hinge means to the end of the pivotal leg remote from the free edge and generally aligned in a plane parallel to the spline, the second clamping member having the wedge mounted on it disposed to be retained in the keeper, the second clamping member being shaped to engage the non-pivotal leg so that when the wedge is retained by the keeper, the end remote from the first clamping member provides a means to close said non-pivotal let and a fulcrum for pivoting said closing means to close said pivotal leg.

3. A binding unit for loose-leaf sheet materials or the like comprising a continuous section of resilient material having two legs, connecting means joining the legs near one end portion of one of the legs and at the end portion of the other leg, the legs extending from the connecting means and each leg terminating in a free edge, the free edges having cooperating material engaging end portions, the connecting means including a spline disposed to provide pivotal movement to the one leg attached to the spline by hinge means at a point on the leg between the free edge of the leg and the end remote from the free edge, the spline being non-pivotally fixed to the end of the other leg, a keeper means mounted on the spline, a wedge that can be retained by the keeper, and means for closing the unit, the closing means including two clamping members being non-pivotally joined together, a lip attached to the end of the pivotal leg remote from the free edge and generally aligned in a plane parallel to the spline, such that the end of the first clamping member can be disposed between the lip and the spline, the end of the second clamping member being non-pivotally joined to the non-pivotal leg, the second clamping member having the wedge mounted on it disposed to be retained in the keeper, said end of the second clamping member joined to said non-pivotal leg provids a means to close said non-pivotal leg and a fulcrum for pivoting said closing means to close said pivotal leg when said wedge is retained by said keeper.

4. A binding unit as described in claim 1, wherein the hinge means is comprised of a flexible web.

5. A binding unit as described in claim 2 which additionally comprises a hinge means connecting the second clamping member to the non-pivotal leg.

6. The binding unit as defined in claim 2, wherein the first clamping member having access walls defining a plurality of holes, and the keeper means having groove walls defining a plurality of first grooves, the holes providing access to the first grooves through the first clamping member, whereby the user can engage the edge of the first grooves to hold the binding unit while applying pressure to the second clamping member to adjust the wedge in the keeper means.

7. A binding unit as described in claim 2, which additionally comprises a second clamping member manipulation pad mounted on the second clamping member and disposed to allow the binding unit to lie in the same plane as the loose-leaf sheet materials or the like, when the binding unit is placed on a plane surface.

8. A binding unit as defined in claim 2 wherein the first clamping member and pivotal leg having remote end walls defining a plurality of holes, and a fifth spline manipulation pad mounted on the spline, the holes providing access to the spline manipulation pad, whereby the user can engage the spline manipulation pad while applying pressure to the second clamping member to adjust the wedge in the keeper means.

9. A binding unit as described in claim 3, wherein that portion of the legs from the spline to the free edges curves such that the outer face of the legs become progressively farther apart, becomes parallel, and then becomes progressively closer together.

10. A binding unit as described in claim 3, wherein the hinge means is comprised of a ball and socket joint.

11. A binding unit as defined in claim 3, which additionally comprises pivotal leg walls defining holes in the remote end of the pivotal leg whereby the spline can extend through the holes, an end spline handle means attached to the spline and spaced outside the pivotal leg.

12. The binding unit as defined in claim 3 wherein the lip is spaced a predetermined distance above the first clamping member selected to allow a preselected movement of the first clamping member between the lip and the spline.

13. A binding unit as defined in claim 3 wherein the spline having a spline wall defining a flexible web whereby the user can further open the legs by flexing the spline at the flexible web.

14. The binding unit as defined in claims 1 or 2, which additionally comprises a handle means attached to the spline, whereby the user can engage the handle means while applying pressure to the second clamping member to adjust the wedge in the keeper means.

15. A binding unit as described in claims 1, 2, or 3, wherein each cooperating material engaging end portion includes a plurality of ridges.

16. A binding unit as described in claims 1, 2, or 3, wherein each cooperating material engaging end portion is comprised of an enlarged planar surface.

17. A binding unit as defined in claims 1, 2 or 3 wherein an end manipulation pad is mounted on the second clamping member near the point where the second clamping member is non-pivotally joined to the first clamping member whereby the user can engage the end manipulation pad to adjust the wedge in the keeper means.

18. A binding unit as defined in claim 1, 2, 3, 8 or 12, wherein the keeper means has first walls defining a plurality of discrete positions for retaining the wedge, whereby the user can force the wedge further into the keeper means to increase the clamping force for closing the unit.

19. A binding unit for loose-leaf sheet materials or the like of the type having an open position for insertion and a closed position wherein the loose-leaf materials are clamped therein comprising a continuous section of resilient material comprising, in combination:

two legs, each of said legs having a free edge and a remote end spaced from said free edge, said free edges having cooperating material-engaging end portions;

connecting means comprising, in combination;

a spline having a first and a second end, said first end of said spline rigidly attached to said remote end of one of said legs; and spline hinge means for coupling the other of said legs to said second end of said spline in a region adjacent said remote end disposed to provide pivotal movement to said other leg;

a keeper means mounted on said spline;

a wedge removably retainable in said keeper; and closing means for moving said free edges between said closed position thereof and said open position thereof, said cooperating material-engaging end portions clampingly securing the loose-leaf sheet materials in said closed position, said moving means comprising:

a first clamping member having a first and second end, said first end coupled to said remote end of said pivotal leg and said first clamping means generally aligned in a plane parallel to said spline; and a second clamping member having a first and second end, said first end rigidly attached to said second end of said first clamping member at a preselected angle, said wedge mounted on said second clamping member remote from said first end.

* * * * *